US005517289A

United States Patent [19]

Ito et al.

[11] Patent Number: 5,517,289

[45] Date of Patent: May 14, 1996

[54] APPARATUS FOR AND METHOD OF FORMING IMAGE

[75] Inventors: Katsuyuki Ito; Toru Ishihara; Toshiro Murano; Masato Sakai, all of Tokyo, Japan

[73] Assignee: OKI Electric Industry Co., Ltd., Tokyo, Japan

[21] Appl. No.: 430,100

[22] Filed: Apr. 27, 1995

Related U.S. Application Data

[63] Continuation of Ser. No. 183,088, Jan. 14, 1994, abandoned, which is a continuation of Ser. No. 968,013, Oct. 19, 1992, Pat. No. 5,321,471.

[30] Foreign Application Priority Data

| | | | |
|---|---|---|---|
| Oct. 30, 1991 | [JP] | Japan | 3-284615 |
| Nov. 22, 1991 | [JP] | Japan | 3-307918 |
| Sep. 21, 1992 | [JP] | Japan | 4-251294 |

[51] Int. Cl.[6] ..... G03G 15/06

[52] U.S. Cl. ..... 355/269; 355/219

[58] Field of Search ..... 355/239, 269, 355/270; 361/225; 118/652

[56] References Cited

U.S. PATENT DOCUMENTS

| | | | |
|---|---|---|---|
| 4,185,910 | 1/1980 | Nomura et al. | 355/305 |
| 4,201,465 | 5/1980 | Oyama et al. | 355/219 |
| 4,571,066 | 2/1986 | Morrison | 355/270 |
| 4,769,676 | 9/1988 | Hideo et al. | 355/269 |
| 4,967,231 | 10/1990 | Hosoya et al. | 355/219 |
| 5,221,946 | 6/1993 | Kohyama et al. | 355/270 |

FOREIGN PATENT DOCUMENTS

| | | | |
|---|---|---|---|
| 0308185 | 3/1989 | European Pat. Off. . | |
| 0400563 | 5/1990 | European Pat. Off. . | |
| 63-186253 | 1/1988 | Japan . | |
| 0033470 | 2/1989 | Japan . | |
| 3103878 | 4/1991 | Japan . | |
| 3101764 | 4/1991 | Japan . | |
| 03-103878 | 4/1991 | Japan | 355/219 |
| 03-101764 | 4/1991 | Japan | 355/219 |
| 2129372 | 5/1984 | United Kingdom . | |

OTHER PUBLICATIONS

Patent Abstracts of Japan, vol. 10, No. 198 (P–476)(2254), Jul. 11, 1986, and JP–A–61–042 669 (Abstract).

*Primary Examiner*—John E. Barlow, Jr.

*Attorney, Agent, or Firm*—Panitch Schwarze Jacobs & Nadel

[57] ABSTRACT

An image forming apparatus having a unit for charging the surface of an image carrier uniformly with electricity, the charging unit being contacted by a conductive element which changes a polarity of toner adhering to the unit, a unit for forming an electrostatic latent image on the surface of the image carrier charged electrically, a unit for developing the electrostatic latent image formed on the surface of the image carrier to thereby form a toner image and a means for transferring and fixing the toner image to a transfer member. The developing unit includes a developing roller which is disposed so as to contact the image carrier. The developing roller is connected to a power source for charging the toner particles on the developing roller with electricity with the same polarity as the charging polarity of the the image carrier, and for applying an electric potential to the developing roller so that the toner particles remaining on the developing roller are stuck to an image portion of the image carrier and the toner particles remaining on a non-image portion of the image carrier are attracted by the developing roller. The developing roller rotates in the direction opposite to that of the image carrier and a peripheral velocity of the developing roller exceeds 1.2 times that of the image carrier. Since the collected toner particles are not necessary to be disposed of, the environment is not polluted and the efficiency of using the toner is improved.

5 Claims, 9 Drawing Sheets

FIG. 12

| TONER | A | B | C | D | E | F | G | H |
|---|---|---|---|---|---|---|---|---|
| AVERAGE VOLUME PARTICLE SIZE d (μm) | 11. 5 | 11. 7 | 11. 7 | 12. 0 | 8. 1 | 8. 5 | 8.2 | 8.4 |
| BET RATIO SURFACE AREA S ($m^2/g$) | 2. 62 | 1. 7 | 1. 56 | 1. 44 | 3. 58 | 2. 33 | 2. 23 | 2. 05 |
| S · d | 30. 1 | 19. 9 | 18. 2 | 17. 3 | 29.0 | 19. 8 | 18. 3 | 17. 2 |

| TONER | I | J | K | L |
|---|---|---|---|---|
| AVERAGE VOLUME PARTICLE SIZE d (μm) | 6. 1 | 6. 4 | 6.6 | 6.2 |
| BET RATIO SURFACE AREA S ($m^2/g$) | 4. 61 | 3. 13 | 2. 76 | 2. 76 |
| S · d | 28. 1 | 20.0 | 18.2 | 17. 1 |

APPARATUS FOR AND METHOD OF FORMING IMAGE

This is a continuation of application Ser. No. 08/183,088, filed Jan. 14, 1994 abandoned, which is a continuation of application Ser. No. 07/968,013, filed Oct. 29, 1992, now issued as U.S. Pat. No. 5,321,471.

BACKGROUND OF THE INVENTION

1. Field of the Invention

The present invention relates to an apparatus for and a method of forming an electrophotographic image, and more particularly to those adapted for various business machines and instruments, especially for a storage device such as a printer.

2. Description of the Prior Art

An electrophotographic image processing apparatus has been conventionally utilized as an electrophotographic printer. Such an image processing system carries out the steps of charging an image carrier, i.e. a photoconductor drum with electricity uniformly, forming a latent image on the photoconductor drum, developing the latent image by toner, transferring the toner on the photoconductor drum to a transfer member, fixing the toner on the transfer member and removing the toner remaining on the photoconductor drum therefrom. There is a technique to remove electricity before the next charging process starts upon completion of the transferring process in order to prevent an afterimage from being formed on the photoconductor drum. The charging process and the transferring process are generally performed by utilizing corona discharge.

Since a harmful substance such as ozone produces through the corona discharge, it has been collected by a filter, etc. However, the use of the filter for a long time causes the degraded collective efficiency and the frequent filter replacement.

An ozone free process where ozone is prevented from generating by employment of a roller type transfer system or a charging roller system is proposed. (refer to Electronic Communication Institute Thesis '77/4 Vol. J60-C NO. 4 pp 213–218).

The roller type transfer system performs the steps of placing a transfer member on a toner image formed by development on the surface of a photoconductor drum, pressing a transfer roller on the transfer member and applying a voltage polarity of which is opposite to that of the toner, to the transfer roller. In this system, an electric field is generated in a gap between the transfer member and the upper layer of the toner image whereby the toner is transferred to the toner member by an electrostatic force of the electric field.

The charging roller system has the same principle as the roller type transfer system for charging the photoconductor drum with electricity. In this system, a voltage is applied to a charging roller so that an electric charge is directly applied to the photoconductor drum, which leads to no generation of ozone.

There is proposed an image forming system eliminating a cleaning process (Refer to Japan Hardcopy '89 Thesis pp 143–146). In this system, the photoconductor drum is exposed to light after the photoconductor drum is uniformly charged with electricity by the corona discharge whereby the surface potential of the exposure portion is attenuated. Toner is stuck to the attenuated portion by reversal development while toner in a thin layer which remains on the photoconductor drum is collected therefrom. That is, since the toner which remains on the nonexposure portion of the photoconductor drum after the completion of the transferring process is charged with electricity with the same polarity as that in the developing process, the toner is attracted by the developing unit owing to the electrostatic force caused by the difference between the surface potential of the photoconductor drum which is charged with electricity and the developing bias.

The employment of this cleaningless process can miniaturize the image processing apparatus and can recollect the remaining toner in the developing process. Therefore the toner is not necessary to be disposed of and can be reused with high efficiency.

However, since the ozone free process collects the remaining toner by a cleaning blade or a brush or the like, the collected toner should be disposed of. Furthermore, in the cleaningless process, since the efficiency of the filter for collecting harmful substance is gradually lowered as the time lapses, the filter has to be maintained and controlled by proper replacement, which becomes troublesome.

Accordingly, even if both the processes are combined with each other, since the photoconductor drum contacts the charging roller while the toner remains stuck to the photoconductor drum after the transferring, the toner is attracted to the charging roller with ease, whereby the remaining toner is difficult to be collected in the developing process, thus leading to deterioration of the printing quality.

SUMMARY OF THE INVENTION

The present invention has solved the problems of the conventional image forming apparatus and provides an image forming apparatus and method which can serve also as the ozone free process and the cleaningless process, eliminate the disposal of the collected toner and the pollution of the environment, and improve the toner use efficiency.

To achieve the object of the present invention, an image forming apparatus according to the first aspect of the present invention comprises a charging unit for charging the surface of an image carrier uniformly with electricity, a latent image forming unit for forming an electrostatic latent image on the surface of the image carrier which has been charged with electricity, a developing unit for developing the electrostatic latent image formed on the surface of the image carrier to thereby form a toner image, and a means for transferring and fixing the toner image formed on the surface of the image carrier to a transfer member.

The developing unit includes a developing roller which is disposed so as to contact the image carrier and is connected to a power source. The power source charges toner particles on the developing unit with electricity with the same polarity as the charging polarity of the the image carrier. The power source applies an electric potential to the developing rollers, allows the toner particles to be stuck to an image portion of the image carrier and of allowing the toner particles remaining on a non-image portion of the image carrier to be attracted by the developing unit.

The turning direction of the developing roller is opposite to that of the image carrier and the peripheral velocity of the developing roller can be set to exceed 1.2 times that of the image carrier.

The charging unit comprises a charging roller. The absolute value of the potential on the charging roller can be decreased during no printing operation while the charging roller is engaging with the surface of the image carrier, or at the end of printing operation.

Furthermore, the turning direction of the charging roller can be opposed to that of the image carrier and the peripheral velocity of the charging roller and that of the image carrier can be differentiated from each other. For example, the peripheral velocity of the charging roller can be less than that of the image carrier, and vice versa. A toner holding unit may be disposed between a transfer unit and the charging unit so as to contact the image carrier to attract the toner particles from the image carrier and returning the toner particles to the image carrier.

Still furthermore, by using a charging roller as the charging unit and a developing roller as the developing unit which is disposed so as to contact the image carrier, a conductive blade can be contacted against the charging roller. In this case, the developing roller is connected to the power source which charges the toner particles on the developing roller with electricity with the same polarity as that of the image carrier.

The power source applies an electric potential to the developing roller, allows the toner particles to be attached to the image portion of the image carrier and allows the toner particles remaining on the non-image portion of the image carrier to be attracted by the developing unit. Furthermore, the conductive blade and the charging roller are respectively connected to the power source which sets the potential of the conductive blade same as that of the charging roller with a large absolute valve.

A method of forming an image according to the present invention comprises the steps of charging the surface of an image carrier with electricity uniformly, forming an electrostatic latent image on the charged image carrier, developing the latent image by attaching toner particles thereto to thereby form a toner image and transferring the toner image to a transfer member.

In the charging step, the charging is performed by contacting a charging member connected to a power source to the surface of the image carrier, without employing a corona discharge system. Although remaining on the image carrier upon completion of the transferring step, the toner particles are not removed by a cleaning device but are collected owing to electrostatic force which is, for instance, generated in the developing step before the transferring step starts after the charging step.

The toner particles may be spherical and have a characteristic value S.d which is a product of BET ratio surface area S [$m^2/g$] and a volume average particle size d [μm] and which is less than 18.

BRIEF DESCRIPTION OF THE DRAWINGS

FIG. 12 is a table showing the characteristic of toner particles employed by the image forming apparatus according to the present invention;

PREFERRED EMBODIMENT OF THE INVENTION

An image forming apparatus are described hereinafter according to the first to sixth embodiments wherein elements common to the first to sixth embodiments are denoted at the same numerals.

FIRST EMBODIMENT (FIGS. 1 to 4)

Figure 1:
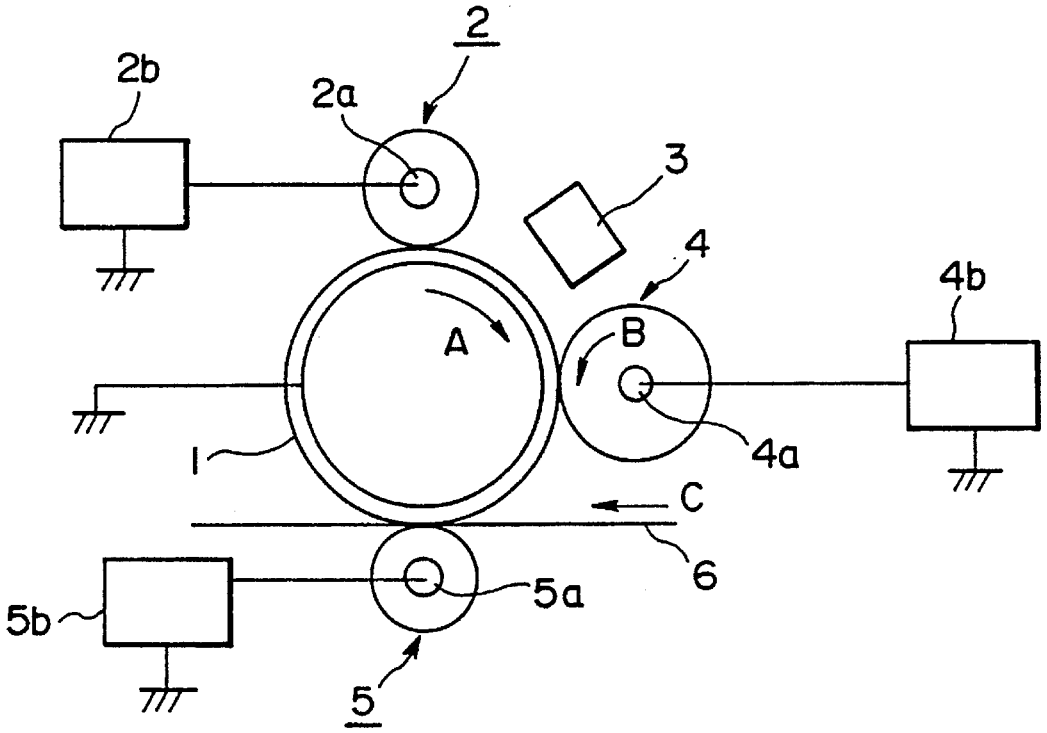
FIG. 1 is a schematic view showing an image forming apparatus according to a first embodiment of the present invention.
Figure 2:
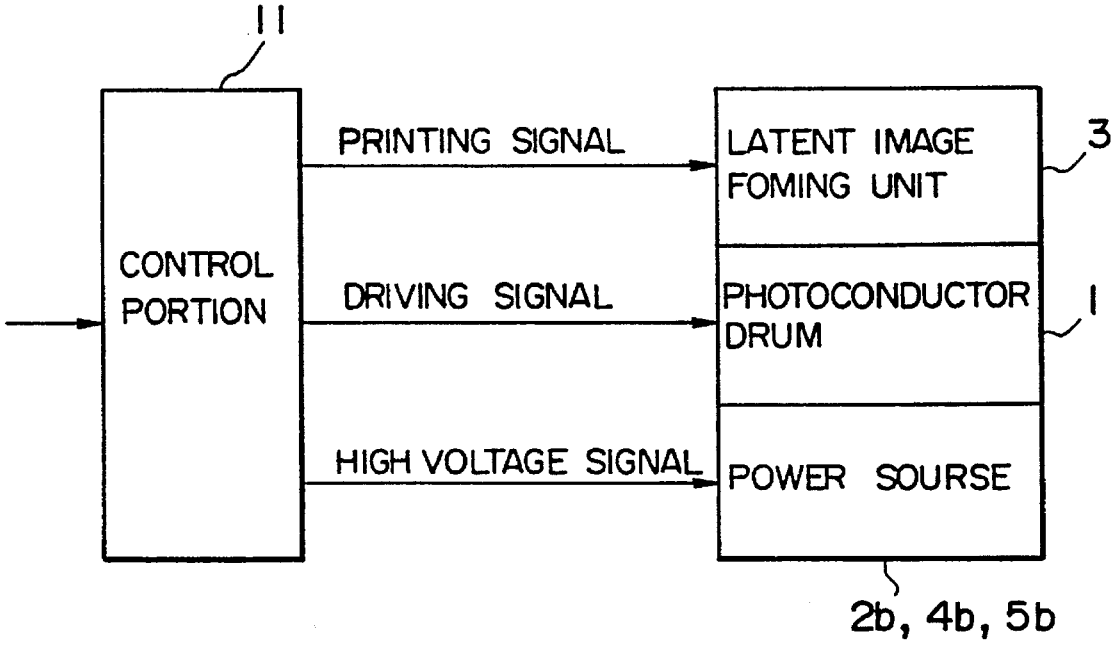
FIG. 2 is a block diagram of the image forming apparatus of FIG. 1.

An image forming apparatus according to a first embodiment of the present invention will be described with reference to FIGS. 1 to 4. FIG. 1 is a schematic view showing the image forming apparatus and FIG. 2 is a block diagram of the image forming apparatus of FIG. 1.

A drum type image carrier, i.e. photoconductor drum 1 rotates in the direction of the arrow A. According to the present embodiment, an organic photoconductor drum (hereinafter referred to as OPC), with a negative polarity is employed as the drum type image carrier. The dielectric layer on the photoconductor drum 1 has a dielectric constant which is expressed as follows.

$\epsilon_p=3.5\ \epsilon_O(\epsilon_O=8.855\times10^{-12}$ [$C/V_m$]: space dielectric constant and the thickness $d_p$ of the photoconductor drum is expressed as $d_p=20$ [μm].

A charging roller 2 constituting a charging unit is formed of a conductive rubber roller. The charging roller 2 contacts to the photoconductor drum 1 at a given pressure and follows in rotation. The charging roller 2 may be rotated by a driving means, not shown, through a gear, etc instead of the friction with the photoconductor drum 1. A fixed type contact charging unit such as a blush may be replaced by the charging roller 2.

The electric resistance of the charging roller 2 is set to be $10^5$ [Ω] but may be set to be approximately on the order of $10^0$ to $10^9$ [Ω]. If the electric resistance is too low, due to a pin hole on the surface of the photoconductor drum 1, a large amount of current is liable to flow into the charging roller 2. On the other hand, if the electric resistance is too high, a stable surface potential is hardly obtained. Accordingly, the electric resistance is preferable to range from $10^4$ to $10^9$ [Ω].

The electric resistance mentioned here means that between the contacting plane where the charging roller 2 contacts the photoconductor drum 1 (an area as large as nip width×longitudinal length) and a conductive shaft 2*a* which supports the charging roller 2. A power source 2*b* applies a voltage to the conductive shaft 2*a*.

A latent image forming unit 3 subjects the photoconductor drum 1 to exposure in light in response to a printing signal and draws an electrostatic latent image comprising an exposure portion and nonexposure portion, on the surface of the photoconductor drum 1. The photoconductor drum 1 according to the first embodiment employs an LED, but it may be a laser beam scanning unit, a liquid crystal shutter array, etc.

A toner carrier, i.e. a developing roller 4 constituting a developing unit contacts to the photoconductor drum 1 at a given pressure and rotates in the direction of the arrow B. According to the first embodiment, the developing roller is formed of a conductive rubber roller. The electric resistance of the developing roller 4 is set to be $10^6$ [Ω] but may be set to be approximately $10^0$ to $10^9$ [Ω]. If the electric resistance is too low, a large amount of current flows into the developing roller 4 when the surface of the developing roller directly contacts to the photoconductor drum 1 in case the photoconductor drum 1 has a pin hole or a small amount of toner on the surface thereof locally. On the contrary, if the electric resistance is too high, the developing efficiency is lowered whereby low density in the eventual printed image is liable to occur. Accordingly, the electric resistance is preferable to range from $10^4$ to $10^8$ [Ω]. The electric resistance mentioned here means that between the contacting plane where the surface of the developing roller 4 contacts the photoconductor drum 1 and the conductive shaft 2*a*.

Toner particles are laminated to several tens μm thick on the developing roller 4 and enter a developing area which contacts the photoconductor drum 1 by a means, not shown, as the developing roller 4 rotates whereby the development is performed. The toner particles carry an electric charge polarity which is the same as the charging polarity of the photoconductor drum 1 so as to perform reversal development between the photoconductor drum 1 and the developing roller 4. In this case, the exposure portion to which toner particles are stuck forms an image portion while the nonexposure portion to which toner particles are not stuck forms a non-image portion. A power source 4*b* applies a voltage to a conductive shaft 4*a*. The power source 4*b* applies an electric potential, which is intermediate between that of the image portion and that of the non-image portion of the photoconductor drum 1, to the developing roller 4.

A transfer roller 5 constituting a transfer unit transfers a toner image on the photoconductor drum 1 to a transfer member 6 which is conveyed toward the allow C. The transfer roller 5 contacts the photoconductor drum 1 at a given pressure and is driven thereby. The transfer roller 5 may be replaced by another means if the latter substantially performs the same function as the former. The transfer member 6 may be a recording paper.

The electric resistance of the transfer roller 5 means that between the contacting plane where the surface of the transfer roller 5 contacts the photoconductor drum 1 and a conductive shaft 5*a*. The electric resistance is set to be $10^8$ [Ω] but may be set to range approximately from $10^0$ to $10^9$ [Ω]. If the electric resistance is too low, a large amount of current flows when the photoconductor drum 1 has pinholes on the surface thereof. If the transfer member 6 has a width less than those of the photoconductor drum 1 and the transfer roller 5, there is not a likelihood of obtaining a sufficient electric field, which causes a poor transfer. On the contrary, if the electric resistance is too high, most of the voltage is applied to the transfer roller 5 so that sufficient voltage is not applied to the toner layer, which causes poor transfer.

The transfer member 6 to which the toner image is transferred is separated from the photoconductor drum 1 and is introduced into a fixing unit, not shown. The transfer member 6 is discharged as a printed matter outside the image forming apparatus upon completion of the fixing process. A power source 5*b* applies a voltage to the conductive shaft 5*a*.

In FIG. 2, a control portion 11 of the image forming apparatus supplies a printing signal to the latent image forming unit 3 so that an LED array head emits light upon reception of the printing signal. The control portion 11 supplies a driving signal to the photoconductor drum 1 so that the photoconductor drum 1 is driven. The control portion 11 further supplies a high voltage signal to the power sources 2*b*, 4*b* and 5*b* so that these power sources set the potentials of the charging roller 2, the developing roller 4 and the transfer roller 5 to the appropriate values.

Figure 3:
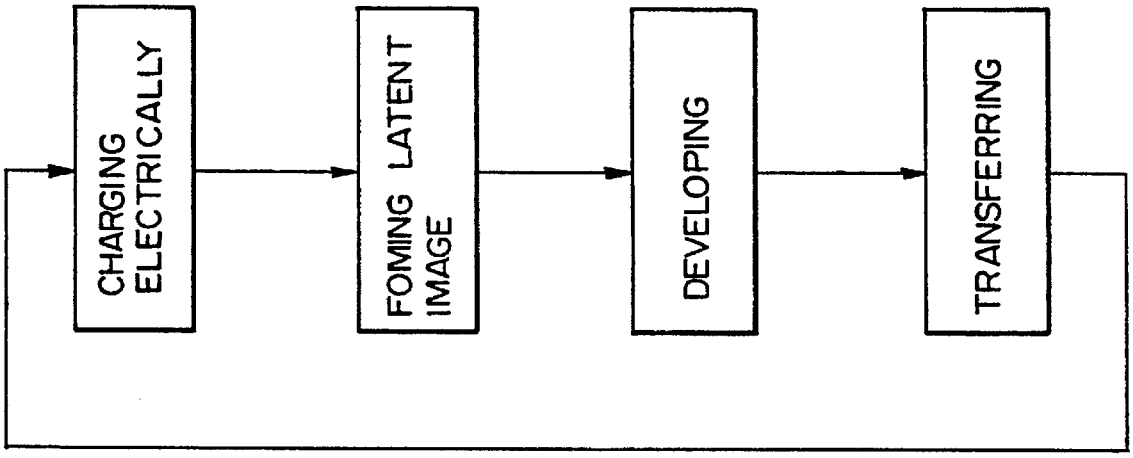
FIG. 3 is a flowchart showing an operation of the image forming apparatus of FIG. 1.

An operation of the image forming apparatus will be described with reference to FIGS. 3 and 4. FIG. 3 is a flowchart showing an operation of the image forming apparatus of FIG. 1 and FIG. 4 is an enlarged view of a developing unit of the image forming apparatus of FIG. 1.

Figure 4:
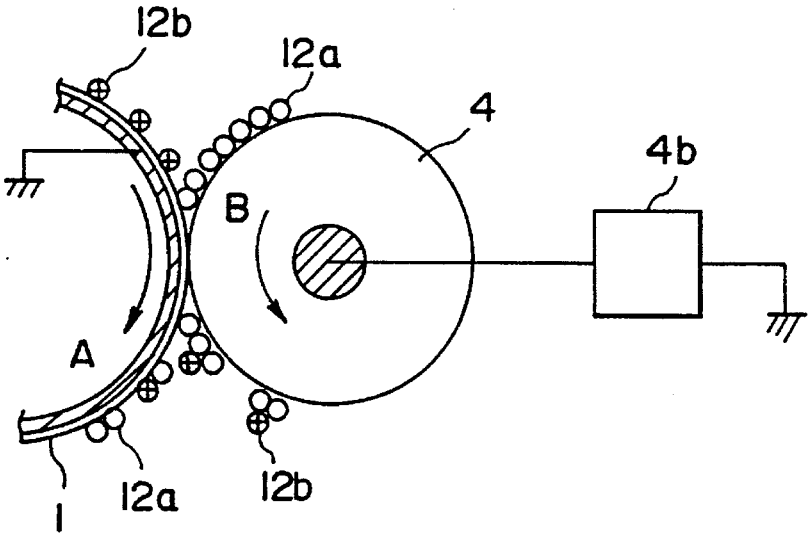
FIG. 4 is an enlarged view of a developing unit of the image forming apparatus of FIG. 1.

In FIG. 4, toner particles 12*a* is stuck to the image portion of the photoconductor drum 1 from the surface of the developing roller 4. Denoted at 4*b* is a power source. The toner particles 12*b* remains on the surface of the photoconductor drum 1 upon completion of the transfer of the toner image on the transfer member 6 (FIG. 1). Since the image forming apparatus has no cleaning means such as a blade, a cleaning brush, etc. according to the first embodiment, the toner particles 12*b* are stuck to the surface of the photoconductor drum 1 to thereby form a residual toner layer and enter a uniformly charged area where the photoconductor drum 1 contacts the charging roller 2.

When the density of the residual toner layer in the uniformly charged area is low, the charged potential difference on the surface of the photoconductor drum 1 due to the presence of the residual toner layer is small so that the surface of the photoconductor drum 1 is uniformly charged with electricity. Thereafter, the surface of the photoconductor drum 1 is subjected to light exposure and is optically drawn on the exposure portion to form a latent image thereon. At this time, if the density of the residual toner layer is low, a spot diameter for optical drawing becomes sufficiently greater .than the size of the toner particle 12*b*, which leads to less influence upon formation of the latent image caused by the presence of the residual toner layer. As a result, an excellent latent image can be obtained.

Successively, the toner particles 12*b* contact the developing roller 4. The potential of the developing roller 4 is controlled to an intermediate value between those of the exposure and nonexposure portions of the photoconductor drum 1 by the power source 4*b*. Accordingly, the toner particles 12*a* remaining on the nonexposure portion are attracted by the developing roller 4 owing to the electrostatic force as illustrated in FIG. 4 and are collected by the developing unit. Meanwhile, the toner particles 12*b* remaining on the exposure portion are not collected by the developing unit but remains stuck to the photoconductor drum 1. The toner particles 12*a* on the developing roller 4 are attracted by the photoconductor drum 1, contrary to the toner particles 12*b*, whereby the latent image on the photoconductor drum 1 is developed to thereby form the toner image. Successively, the toner image on the photoconductor drum 1 is transferred to the transfer member 6 by the transfer roller 5, whereby one cycle of image forming operation is completed. A toner image transfer efficiency of the transfer roller 5 is much higher than that by the conventional corona discharge, which allows the toner particles 12*b* to remain less on the photoconductor drum 1.

Since the developing roller 4 develops the latent image by contacting the photoconductor drum 1, a large amount of the toner particles 12*b* can be collected and the toner particle collection efficiency is much improved compared with that of the conventional non-contact magnetic brushing developing system.

If the peripheral velocity of the developing roller 4 in the direction of the arrow B is greater than that of the photoconductor drum 1 in the direction of the arrow A, particularly, if the former exceeds 1.2 times the latter, an experiment data showed that the toner particles 12*b* on the photoconductor drum 1 move toward the developing roller 4, which leads to a high toner particle collection efficiency. It is possible to develop the latent image on the photoconductor drum 1 with sufficient amount of toner particles stuck to the photoconductor drum 1. Accordingly, even if the amount of toner particles is less supplied to the developing roller 4 so as to form a thin toner layer thereon since the amount of the toner particles 12*b* which corresponds to the difference in the peripheral velocity between the developing roller 4 and the photoconductor drum 1 is collected by the developing unit 4, so that the collected toner particles are supplied additionally to the thin toner layer thereon.

Figure 5:
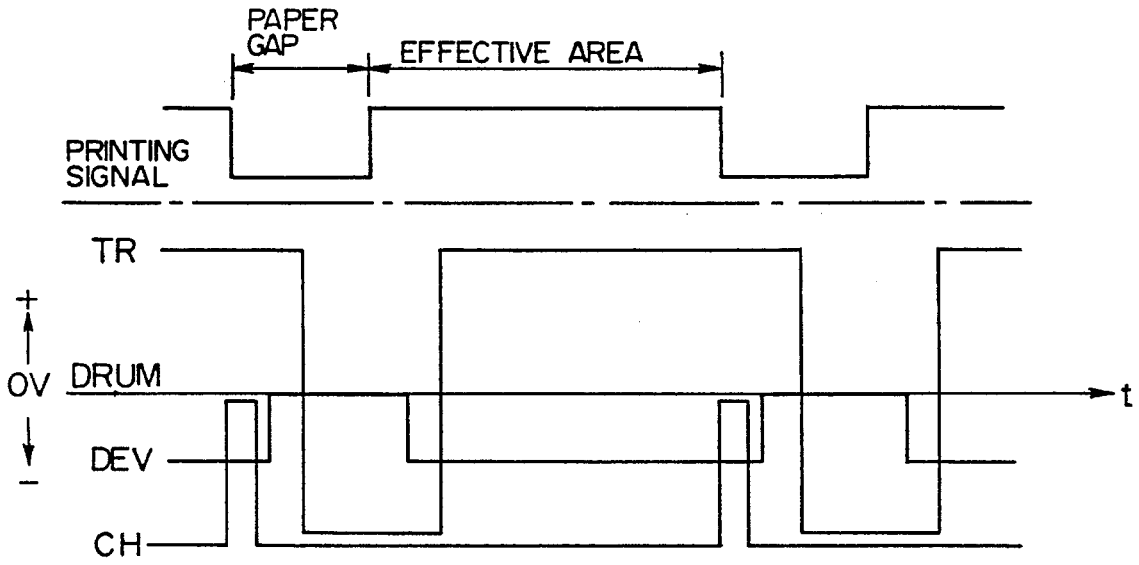
FIG. 5 is a time chart of an image forming apparatus according to a second embodiment of the present invention.
Figure 6:
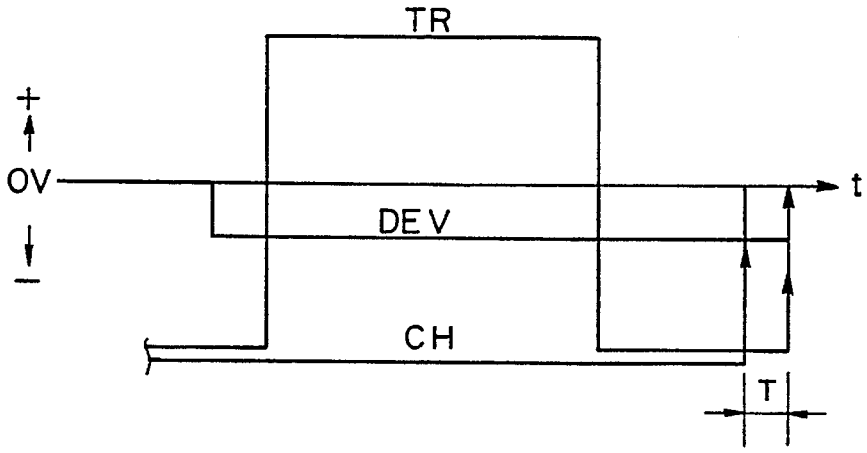
FIG. 6 is a time chart of an image forming apparatus according to a third embodiment of the present invention.

SECOND AND THIRD EMBODIMENT (FIGS. 5 and 6)

An image forming apparatus according to a second and a third embodiments will be described with reference to FIGS. 5 and 6. FIG. 5 shows a time chart of an image forming apparatus according to the second embodiment and FIG. 6 shows a time chart of an image forming apparatus according to the third embodiment.

The latent image forming unit 3 subjects the photoconductor drum 1 to light exposure upon reception of the printing signal from the control portion 11 (FIG. 2). At this instance, the printing signal is made valid corresponding to the motion of the transfer member 6 but is made invalid at the gap between the transfer members (hereinafter referred to as a paper gap). A power source 5*b* of the transfer roller 5 is controlled according to the paper gap. That is, the power source 5*b* controls to permit the potential TR of the transfer roller 5 (FIG. 1) to be at the polarity for transferring the toner particles 12*a* (FIG. 4) to the transfer member 6 when the transfer member 6 is positioned between the transfer roller 5 and the photoconductor drum 1, while it permits the potential TR to be at the polarity inverse to that at the time of transferring process in order to prevent the toner particles 12*a* from being transferred to the transfer roller 5 as illustrated in FIG. 5.

The potential CH of the charging roller 2 is controlled by the power source 2*b* so as to be temporarily reduced in absolute value from the value necessary for charging to 0 [V] during the time when the charging roller 2 passes the area of the photoconductor drum 1 corresponding to the paper gap. At this time, the surface of the photoconductor drum 1 is negatively charged since there remains the electric charge, which was supplied thereto at the time when the charging roller 2 passed, on the surface of the photoconductor drum 1. Accordingly, the positively charged toner particles 12*b* which remains on the photoconductor drum 1 and are attracted by the charging roller 2 are attracted by the photoconductor drum 1 owing to electrostatic force. If the potential CH of the charging roller 2 is set to be 0 [V], the potential of the photoconductor drum 1 is lowered so that the toner particles 12*a* on the developing roller 4 moves to the photoconductor drum 1 and attached thereto. Therefore, an absolute value of a potential DEV of the developing roller 4 is lessened to be 0 [V] at the time when the developing roller 4 reaches the portion corresponding to the paper gap.

Since the portion corresponding to the paper gap moves as the photoconductor drum 1 rotates, the timing for setting the potential CH of the charging roller 2 to 0 [V], the timing for setting the potential DEV of the developing roller 4 to 0 [V] and the timing for setting the polarity of the potential TR of the transfer roller 5 to the inverse polarity are respectively shifted from one another.

In the developing process, most of the toner particles 12*a* which are moved from the developing roller 4 to the photoconductor drum 1 are negatively charged but some of them are positively charged. The positively charged toner particles 12*a* remains on the photoconductor drum 1 after completion of the transferring process and are liable to be stuck to the charging roller 2. Since the absolute value of the potential CH of the charging roller 2 is lessened every time the charging roller 2 reaches the portion corresponding to the paper gap, the toner particles 12*b* stuck to the charging roller 2 are removed so that the amount of the toner particles 12*b* remaining thereon is decreased, whereby the uniform continuous charging can be performed.

As illustrated in FIG. 6, if the absolute value of the potential CH of the charging roller 2 is lessened during a given time T before the photoconductor drum 1 stops its rotation, the toner particles 12*b* stuck to the charging roller 2 can be removed. Since the continuous printing is rarely performed, the toner particles 12*b* stuck to the charging roller 2 can be sufficiently removed in such a manner.

As described in the first embodiment, if the residual toner particles 12*b* are collected in the developing process and the surface of the photoconductor drum 1 is charged with electricity by the charging roller 2 without generating ozone, the photoconductor drum 1 is prevented from charging with electricity in the charging process when the toner particles 12*b* remaining on the surface of the photoconductor drum 1 in the transfer process pass between the charging roller 2 and the photoconductor drum 1, whereby the portion to which the tone particles 12*b* are stuck can not be charged with electricity. Consequently, since the electrostatic force does not influence the toner particles 12*b* in the developing process, the toner 12*b* can not be sufficiently collected, which causes the generation of a positive afterimage on the transfer member 6 in the next transferring process.

A large amount of the residual toner particles 12*b* causes a disadvantages in the expose process. If toner 12*b* is covered thickly on the surface of the photoconductor drum 1, light cannot reach the photoconductor drum 1 because the toner 12*b* absorbs it, thus resulting in poor exposure.

The poor light exposure to the image portion causes to collect the toner 12*b* in the following process, without developing and sticking new toner particles. As a result, the portion corresponding to the previous image portion looms up white, or the so-called negative afterimage, in the present image portion.

A fourth embodiment set forth hereafter prevents the insufficient charging and exposure owing to the remaining toner particles 12*b* and also prevents the positive or negative afterimage from generating.

FOURTH EMBODIMENT (FIG. 7)

Figure 7:
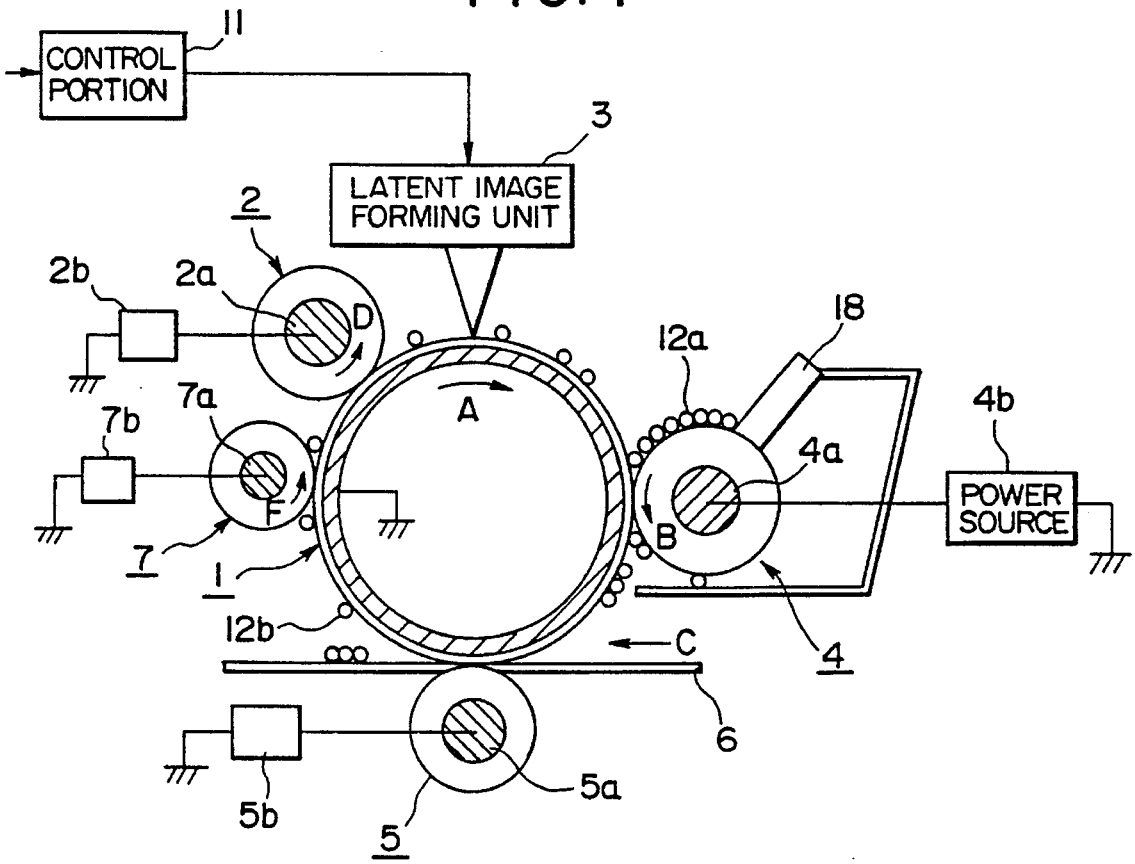
FIG. 7 is a schematic view showing an image forming apparatus according to a fourth embodiment of the present invention.

An image forming apparatus according to the fourth embodiment of the present invention will be described hereinafter with reference to FIG. 7.

A drum-type image carrier, i.e. a photoconductor drum 1 rotates in the direction of the arrow A. A negative type OPC is employed in the fourth embodiment. The charging roller 2 constituting a charging unit is formed of a semi-conductive rubber roller at the surface thereof. The power source 2*b* supplies a voltage to the conductive shaft 2*a*.

The charging roller 2 rotates in the direction of the arrow D. Its peripheral velocity is greater than that of the photoconductor drum 1 and is set to be at the ratio of 1:1.1 to 1:2 relative to that of the photoconductor drum 1.

The voltage of the power source 2*b* is 1.3 [kV] and the surface potential of the photoconductor drum is −800 [V].

The latent image forming unit 3 subjects the photoconductor drum 1 to light exposure in response to the printing signal supplied by the control portion 11 and drafts an electrostatic latent image comprising exposure portion and nonexposure portion on the surface of the photoconductor drum 1. Although the photoconductor drum 1 employs an LED according to the fourth embodiment, it may be a laser beam scanning unit, a liquid crystal shutter array, etc.

A toner carrier, i.e. a developing roller 4 constituting a developing unit contacts the photoconductor drum 1 at a given pressure and rotates in the direction of the arrow B at the peripheral speed with the ratio of 1:1.1 to 1:1.5 relative to the photoconductive drum 1. The surface of the developing roller is formed of a semiconductor rubber. The power source 4*b* applies a voltage to the conductive shaft 4*a*. With the application of the voltage to the conductive shaft 4*a*, there appears the potential on the developing roller 4 which potential is substantially intermediate between that of the image portion, the exposure portion of the photoconductor drum 1 and that of the non-image portion, i.e., the nonexposure portion of the developing roller 4. The potential on the developing roller 4 is set to be −350 [V].

The toner particles 12*a* on the developing roller 4 thinned to several tens μm thick by a developing blade 18 enter the developing area where the developing roller 4 contacts the photoconductor drum 1 as the developing roller 4 rotates and then developed. The toner particles 12*a* have the same negative charge as that of the photoconductor drum 1 and a reversal development is performed. At this state, the toner particles 12*a* stuck to the exposure portion forms the image portion while the toner particles 12*a* sticks to the nonexposure portion and forms the non-image portion.

The transfer roller 5 constituting the transfer unit transfers the toner image formed on the photoconductor drum 1 to the transfer member 6 which is conveyed in the direction of the arrow C by a means, not shown. The transfer roller 5 is structured so as to contact the photoconductor drum 1 at a given pressure and follows rotatably. The roller 5 may be replaced by other means if the same function can be attained.

The transfer member 6 to which the toner image has been transferred is separated from the photoconductor drum 1 and is introduced into a fixing unit, not shown. Thereafter the number 6 is discharged as a printed matter outside the image forming apparatus. The power source 5*b* applies a voltage to the conductive shaft 5*a*.

A toner holding roller 7 is formed of a semiconductive rubber or a semiconductive sponge at the surface thereof. Electric resistance of the semiconductive rubber or sponge ranges from $10^3$ to $10^9$ [Ω]. The voltage ranging from +100 to +700 [V] is applied to a conductive shaft 7*a* which supports a toner holding roller 7. The toner holding roller 7 rotates in the direction of the arrow F. The peripheral velocity thereof is greater than that of the photoconductor drum 1 and is set to be 1 to 2 times that of the photo conductor drum 1. The toner particles 12*b* negatively charged remain on the photoconductor drum 1.

An operation of the image forming apparatus according to the fourth embodiment will be described hereinafter.

The negatively charged toner particles 12*b* which remain on the photoconductor drum 1 in the transferring process are attracted by the toner holding roller 7 owing to the electrostatic force. Moreover, the toner particles 12*b* stuck to the toner holding roller 7 are positively charged using the toner holding roller 7, thus sticking again to the photoconductor drum 1. At this time, the positively charged toner particles 12*b* on the toner holding roller 7 are stuck to both the image and non-image portions of the photoconductor drum 1. Accordingly, the thickness of the toner particle layer on the toner holding roller 7 is increased without dropping outside.

As mentioned above, although the toner particles remaining on the photoconductor drum 1 are once stuck to the toner holding roller 7, they are gradually returned to the photoconductor drum 1 with the toner holding roller 7 rotating. This is particularly effective in case there are much toner particles 12*b* remaining on the photoconductor drum 1 . The toner particles 12*b* once stuck by the toner holding roller 7 are successively returned to the photoconductor drum 1 and make the thin toner layer on the photoconductor drum 1.

This is more effective if the peripheral velocity of the toner holding roller 7 is set to be 1:1.3 relative to that of the photoconductor drum 1.

In the charging process, the toner particles 12*b* between the charging roller 2 and the photoconductor drum 1 move on the charged photoconductor drum 1 due to the charging roller 2 since the peripheral velocity of the charging roller 2 is greater than that of the photoconductor drum 1. Accordingly, the surface of the photoconductor drum 1 is charged with electricity uniformly at the portion where the toner particles 12*b* were stuck before the movement of the toner particles and at the portion where the toner particles 12*b* have been stuck again after the movement of the toner particles 12*b*. The larger the peripheral velocity ratio of the charging roller to the photoconductor drum 1 is, the more stably the portion where the toner particles 12*b* are attached can be charged with electricity. However, it was practically effective when the peripheral velocity ratio is 1:1.3. At this time, the toner particles 12*b* are negatively charged since the negative charge is introduced thereinto by the charging roller 2.

In the exposure process, since the light for exposure is shaded at the portion where the toner particles 12*b* are attached thicker on the photoconductor drum 1, the same portion is not exposed sufficiently. However, according to the fourth embodiment, since the toner particles 12 are distributed sparsely on the photoconductor drum 1 owing to the provision of the toner holding roller 7, there is no likelihood of occurrence of insufficient exposure, the so-called negative afterimage.

In the developing process, the developing roller 4 has a potential which is intermediate between that of the nonexposure portion and that of the exposure portion of the photoconductor drum 1. The negatively charged toner particles 12*b* remaining on the nonexposure portion attracted by the developing roller 4 owing to the electrostatic force. Meanwhile, the negatively charged toner particles 12*b* remaining on the nonexposure portion are not attracted by the developing roller 4 since the exposure portion is at the exposure potential. On the contrary, new toner particles 12*a* are moved from the developing roller 4 and stuck to the exposure portion owing to the electrostatic force.

Thereafter, the toner image is transferred to the transfer member 6 in the transferring process by the electrostatic force caused by the transfer roller 5. The toner image on the transfer member 6 is fixed thereto by a fixing device, not shown.

Although the peripheral velocity of the charging roller is greater than that of the photoconductor drum 1 according to the fourth embodiment, the former can be less than the latter.

Figure 8:
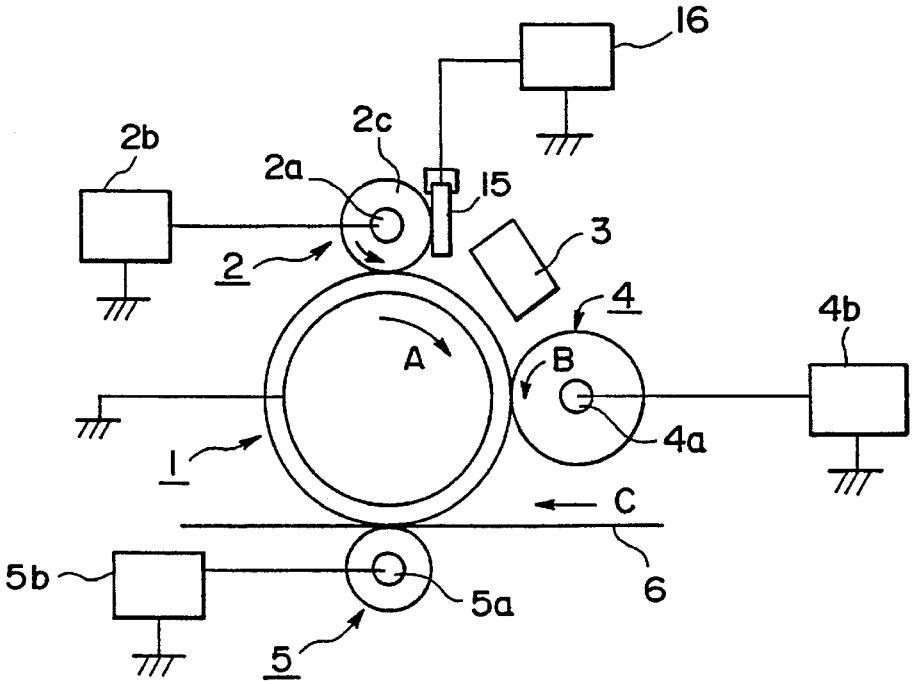
FIG. 8 is a schematic view showing an image forming apparatus according to a fifth embodiment of the present invention.
Figure 9:
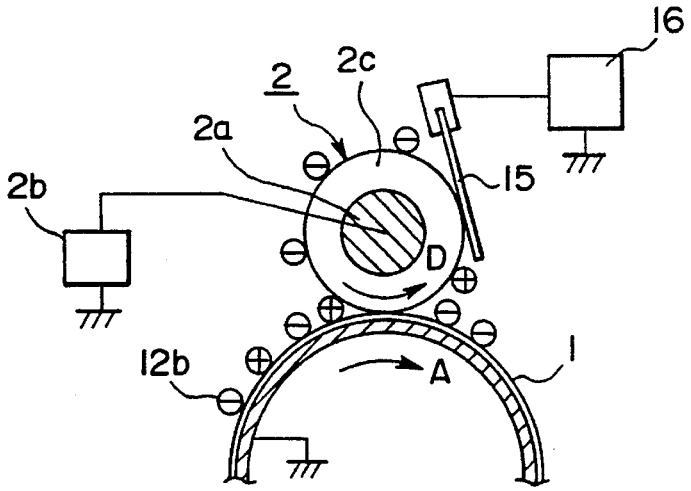
FIG. 9 is an enlarged view showing a charging roller of the image forming apparatus of FIG. 8.

FIFTH EMBODIMENT (FIGS. 8 and 9)

An image forming apparatus according to a fifth embodiment of the present invention will be described with reference to FIGS. 8 and 9. FIG. 8 shows a schematic view showing the image forming apparatus and FIG. 9 is an enlarged view of a charging roller which is used in the image forming apparatus of FIG. 8.

A photoconductor drum 1 rotates in the direction of the arrow A. A negative type OPC is employed as the photoconductor drum.

The charging roller 2 has a layer formed of a semiconductive rubber 2*c* around the conductive shaft 2*a*. The semiconductive rubber 2*c* has a volumetric resistance value which ranges from $10^5$ to $10^{10}$ [Ωcm]. The charging roller 2 rotates in the direction of the arrow while the photoconductor drum 1 rotates in the direction of the arrow A. The peripheral velocity of the charging roller 2 is less than that of the photoconductor drum 1 and the former is set to be 0.95 to 0.5 times the latter. The power source 2*b* is connected to the conductive shaft 2*a* to apply the voltage to it.

A conductive blade 15 is formed of a flexible metal plate and is fixed so as to press against the surface of the charging roller 2. The conductive blade 15 is connected to a power source 16. It is preferable to set the voltage of the power source 2*b* to be approximately −1000 [V] and the voltage of the power source 16 to be approximately −1200 [V] in order to charge the photoconductor drum 1 uniformly with the potential of −600 [V]. That is, the potential difference of ranges of −50 to −300 [V] is applied between the charging blade 15 and the charging roller 2.

The arrangements of the latent forming unit 3, the developing roller 4, the transfer roller 6 and the power source are same as those of the fourth embodiment, hence the explanation thereof are omitted.

An operation of the fifth embodiment will be described hereinafter.

The toner particles 12*b* remain on the photoconductor drum 1 which has transferred the toner image on to the transfer member 6. The residual toner layer stuck to the photoconductor drum 1 enters a uniformly charged area where the photoconductor drum 1 contacts to the charging roller 2. If the density of the residual toner layer is low, the potential difference on the photoconductor drum 1 due to the presence and the absence of the residual toner layer is small, whereby the uniform charging can be performed.

After the toner image transferring, the toner particles 12*b* with the positive and negative polarities remains on the photoconductor drum 1. The charging roller 2 is charged by the power source 16 so as to carry a negative polarity relative to the photoconductor drum 1. Accordingly, the charging roller 2 charges the photoconductor drum 1 with electricity and at the same time attracts the positively charged toner particles 12*b* owing to the electrostatic force. Whereupon, the negatively charged toner particles 12*b* which remain on the photoconductor drum pass the uniformly-charged area. The peripheral velocity of the charging roller 2 is 0.95 to 0.5 time that of the photoconductor drum 1. The toner particles 12*b* which are stuck to the charging roller 2 rotating at low speed move toward the photoconductor drum 1 rotating at high speed. If the difference between the velocity of the charging roller 2 and that of the photoconductor drum 1 is increased, the amount of the toner particles 12*b* which moves to the latter from the former is reduced but the mechanical load applied to the photoconductor drum 1 is increased owing to the friction.

When the positively charged toner particles on the charging roller 2 pass the pressing contact portion between the conductive blade 15 and itself, they are negatively charged at the pressing contact portion since the potential is applied to the conductive blade 15 by a power source 16 so that the conductive blade 15 carries negative polarity relative to that of the charging roller 2. Thereafter, the charging roller 2 rotates and the toner particles 12*b* thereon enters again the uniformly charged area. At this time, the negatively charged toner particles 12*b* move toward the photoconductor drum 1.

As mentioned above, since the density of the toner particles 12*b* stuck to the charging roller 2 is always kept to low, the charging can be uniformly maintained. Thereafter, the latent image forming apparatus 3 subjects the surface of the photoconductor drum 1 to light exposure to thereby form the latent image on the surface of the photoconductor drum 1.

Successively, the toner particles 12*b* remaining on the photoconductor drum 1 contact the developing roller 4. The power source 5*b* applies an intermediate potential between that of the nonexposure portion and that of the exposure portion of the photoconductor drum 1 to the developing roller 4 value. Accordingly, the toner particles 12*b* remaining on the nonexposure portion are stuck by the developing roller 4 owing to the electrostatic force and are collected by the developing unit. On the contrary, the toner particles move from the developing roller 4 to the exposure portion and are stuck to the exposure portion where the latent image is developed and the toner image is formed.

Thereafter, the toner image on the photoconductor drum 1 is transferred to the transfer member 6 by the transfer roller 5, whereby one cycle of the image forming operation is completed.

Figure 10:
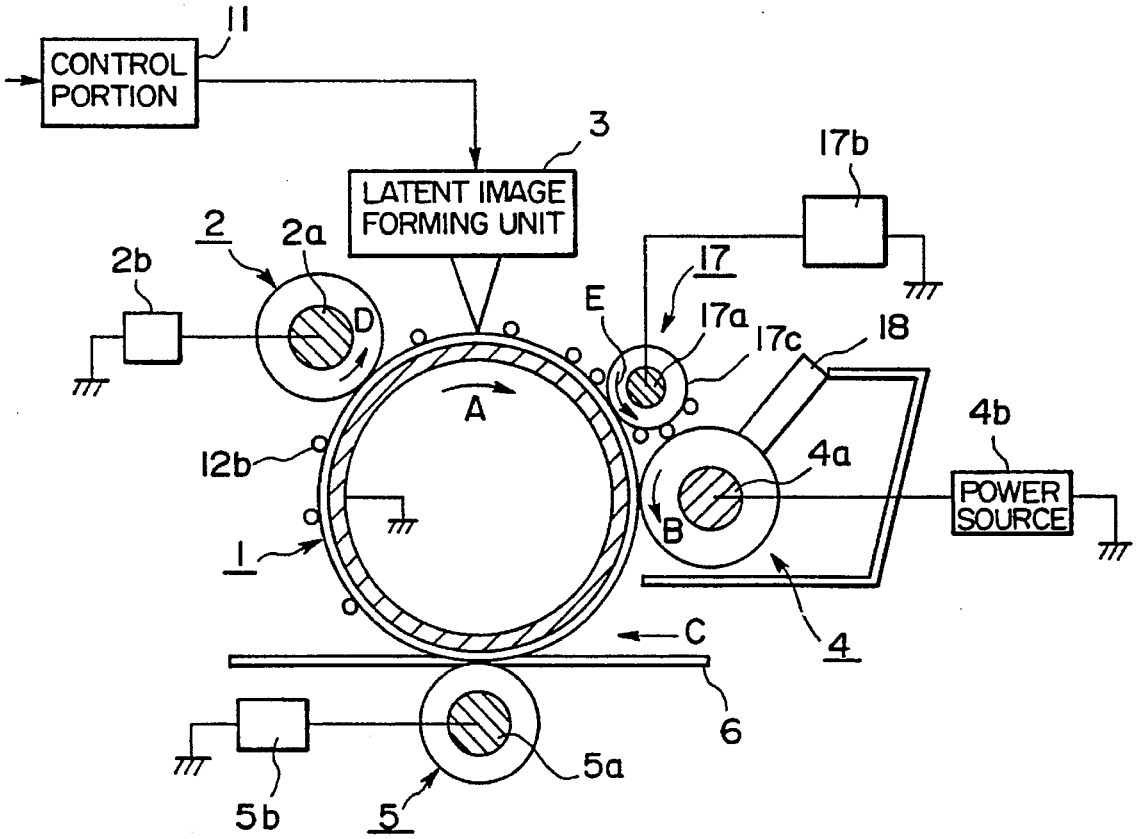
FIG. 10 is a schematic view showing an image forming apparatus according to a sixth embodiment of the present invention.
Figure 11:
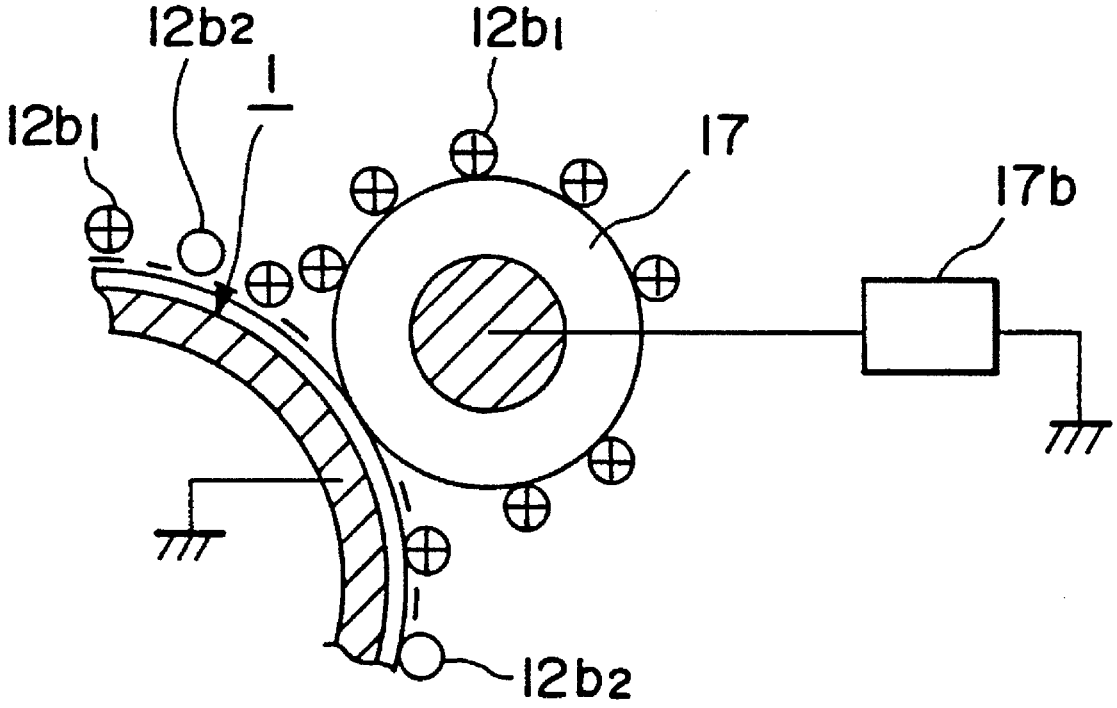
FIG. 11 is an enlarged view of a cleaning roller of the image forming apparatus of FIG. 10.

SIXTH EMBODIMENT (FIGS. 10 and 11)

An image forming apparatus according to a sixth embodiment will be described with reference to FIGS. 10 and 11. FIG. 10 is a schematic view showing the image forming apparatus and FIG. 11 is an enlarged view of an auxiliary developing roller which is used by the apparatus of FIG. 10.

The arrangement of the image forming apparatus according to the sixth embodiment is same as that of the fourth embodiment except the auxiliary developing roller. The arrangement of the auxiliary developing roller will be described hereinafter.

An auxiliary developing roller 17 is formed of a semiconductive rubber layer 17*c* at the surface thereof and contacts the photoconductor drum 1 at a given pressure. The auxiliary developing roller 17 has an electric resistance which ranges $10^4$ to $10^9$ [Ω] between the surface thereof and a conductive shaft 17*a*. A power source 17*b* applies a voltage to the auxiliary developing roller 17. The auxiliary developing roller 17 rotates in the direction opposite to that of the photoconductor drum 1, i.e. in the direction of the arrow E. The peripheral velocity thereof is set to be 1.0 to 3.0 times that of the photoconductor drum 1.

An operation of the sixth embodiment will be described hereinafter.

After the latent image is formed on the photoconductor drum 1 by the latent image forming unit 3, the toner particles 12*b* on the photoconductor drum 1 enter the contact portion between the surface thereof and the auxiliary developing roller 17 as the photoconductor drum 1 rotates. According to the sixth embodiment, since the toner particles 12*b* remaining on the photoconductor drum 1 are negatively charged and the surface potential of the photoconductor drum 1 is about −700 [V] after photoconductor drum 1 has been charged, the voltage of the power source 17*b* is set to be about −200 [V]. Accordingly, the toner particles $12b_1$, remaining on the nonexposure portion of the photoconductor drum 1 are attracted toward the auxiliary developing roller 17 owing to the electrostatic force. Toner particles $12b_2$ remaining on the exposure portion of the photoconductor drum 1 are not attracted by the auxiliary developing roller 17 but remain on the photoconductor drum 1. The toner particles $12b_2$ remaining on the photoconductor drum 1 occur no problem since in the succeeding developing process the toner particles 12*a* are stuck to the portion where the toner particles $12b_2$ were stuck.

The toner particles $12b_1$ attracted by the auxiliary developing roller 17 contact again the photoconductor drum 1. At this time, when the toner particles $12b_1$ contact the exposure portion on the photoconductor drum 1, they are attracted toward the photoconductor drum 1. In such a manner, since the toner particles $12b_1$ attracted by the auxiliary developing roller 17 are consumed by being stuck to the exposure portion, they do not remain thick on the auxiliary developing roller 17. Thereafter, the photoconductor drum 1 contacts the developing roller 4 whereby the latent image is developed and the toner image is formed. Successively, after the toner image is transferred to the transfer member 6 by the transfer roller 6, thus one cycle of the image forming operation is completed.

A polymerizing method for manufacturing the toner particles can eliminate a pulverizing method and can achieve a high productivity compared with a pulverizing method and furthermore sizes of the toner particles can be controlled relatively with ease. Accordingly, it is possible to reduce the sizes of the toner particles to thereby contribute to obtaining a high resolution and a high quality image. The toner particles manufactured by the polymerizing method are spherical or substantially spherically shaped owing to the characteristics of its manufacturing method. The spherical toner particles have a strong Van der Waals attaching force to the photoconductor drum compared with indefinite toner particles in view of its shape, and are hardly caught by a blade, a brush, etc., which causes an inferior cleaning. The smaller the particle size is, the more remarkable this tendency is.

There is proposed a method of forming desired shaped toner particles by cohering the minute toner particles which have sizes ranging from 1 to 4 [μm] which were obtained by the polymerizing method and successively by melting the minute particles at the contact points thereof (refer to Japanese Patent Laid-Open Publication No. 63-186253). However, this method complicates for manufacturing the toner particles and costs high.

In view of the drawbacks of this method, described hereinafter is a method which is capable of using spherical toner particles which are manufactured by the polymerizing method and is cheap in running costs thereof.

SEVENTH EMBODIMENT (FIG. 12)

A seventh embodiment will be described hereinafter with reference to FIG. 12 showing characteristics of the toner particles which are used in the image forming apparatus.

Data in the table of FIG. 12 show the result of employment of various toner particles by the image forming apparatus in FIG. 1.

Toner particles as denoted at A, E and I are manufactured by the pulverizing method, at B to D, F to H and J to L are respectively manufactured by the polymerizing method. Styrene acrylic copolymer is employed as a binding resin. The amount of charging control agent is regulated so that the thin layer of the toner particles on the developing roller 4 has an average thickness of 20 [μm] and a specific charge per toner q/m establishes the expression of q/m=−10±1 [μC/g].

If the average thickness of the toner layer is less than 15 [μm], the toner particles become in short supply so that a sufficient image density can not be obtained. If the average thickness of the toner layer exceeds 30 [μm], an electric field for collecting the toner particles by the developing roller 4 is weakened, so that the toner particles can not be sufficiently collected. If the specific charge per toner q/m is less than −5 [μC/g], there is a likelihood of occurrence fog on the surface of the nonexposure portion, which leads to the deterioration of the image. If the specific charge per toner exceeds −20 [μC/g], it becomes difficult to transfer the image toner, which causes an inferior transfer.

S.d is a product of a BET ratio surface area S [$m^2$/g] and a volume average particle size d [μm] and is a characteristic value representing the shape of the toner particles. That is, if the characteristic value S.d becomes greater, it means that the toner particles are more indefinite while if it becomes smaller, it means that the toner particles are more spherical. S/d is sometimes employed as the characteristic value representing merely the shapes of the toner particles. However, if S/d is employed as such, it is impossible to compare the shapes of those which have different average particle sizes with each other Accordingly, the S.d is employed as the characteristic value in order to institute the comparison between the toner particles which have different average particle sizes.

Figure 13:
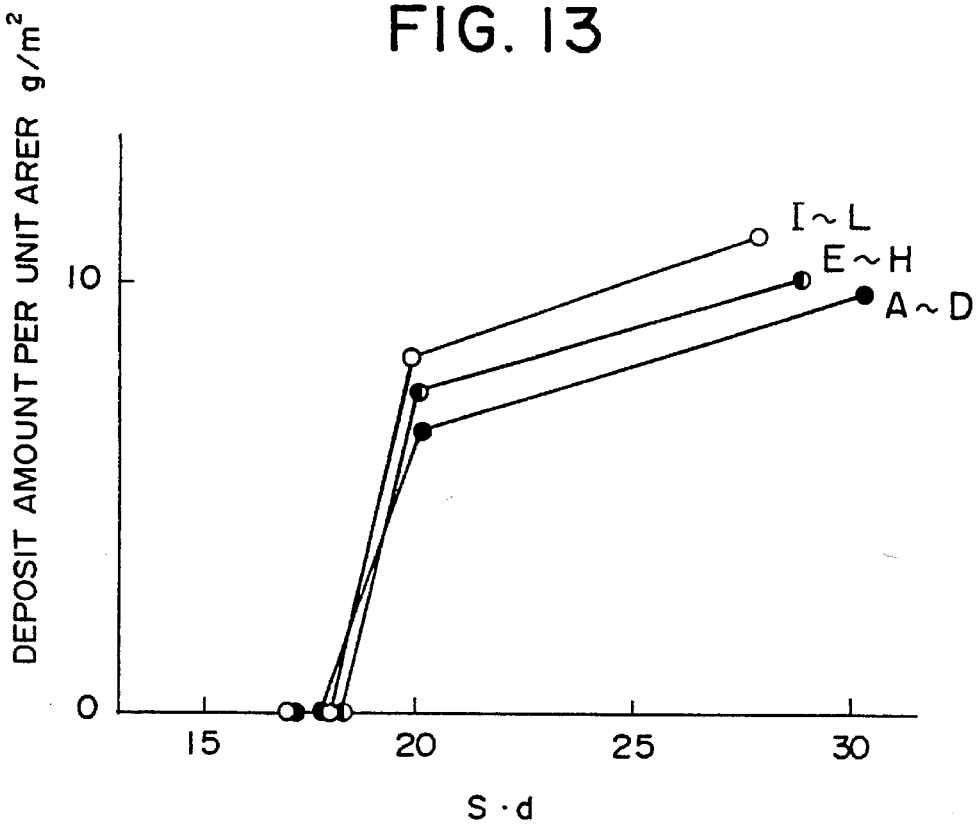
FIG. 13 is a view showing the relation between the characteristic value of toner particles and the amount of toner particles attached to the charging roller.

FIG. 13 is a view showing the relation between the characteristic value S.d and the toner particle deposit per unit area of the charging roller 4. The data in FIG. 13 is a result of test showing the deposit per unit area, i.e. the amount of toner particles attached to the surface of the chafing roller (FIG. 1) after the completion of the continuous printing of the 500 pieces of sheets (A4 size) at [25%] duty cycle using various toner particles.

Assume that the voltage of the power source 2*b* is −1.4 [kV], the surface potential of the photoconductor drum 1 is −840 [V] at the state where the toner particles are not supplied to the image forming apparatus, i.e. where the toner particles are neither attached to the charging roller 2 nor to the photoconductor drum 1. The voltage of the power source 4*b* is −300 [V] and the voltage of the power source 5*b* is +2 [kV].

As illustrated in FIG. 13, when the characteristic value S.d exceeds about 18, it is understood that the residual toner particles are stuck to the surface of the charging roller 2. If the characteristic value S.d exceeds about 20, it is confirmed that the toner particles remained on the surface of the charging roller 2 form a uniform layer having the thickness which ranges from 10 to 20 [μm] or more. If the characteristic value S.d is less than 18, the toner particles do not remain on the charging roller 2 even if the continuous printing of 10,000 pieces of sheets is performed. Any of the toner particles A to L which remain on the surface of the photoconductor drum 1 is collected by the developing roller 4, which leads to no generation of the afterimage caused by the inferior collection of the toner particles.

Successively, another similar test was made under the condition that the voltage of the power source 2*b* is −1.1 [kV] or −1.6 [kV]. This test revealed that there is approximately 2% difference between the mass of deposit per unit area, i.e. the amount of various toner particles to be stuck to the charging roller 2 under this test and that under previous test, i.e. the test as illustrated in FIG. 13.

That is, the presence or the amount of the remaining toner particles stuck to the charging roller 2 is not much varied although the voltage variation of the power source 2*b* varies the electric field at the charging process, which shows that it depends largely on the characteristic value S.d.

Figure 14:
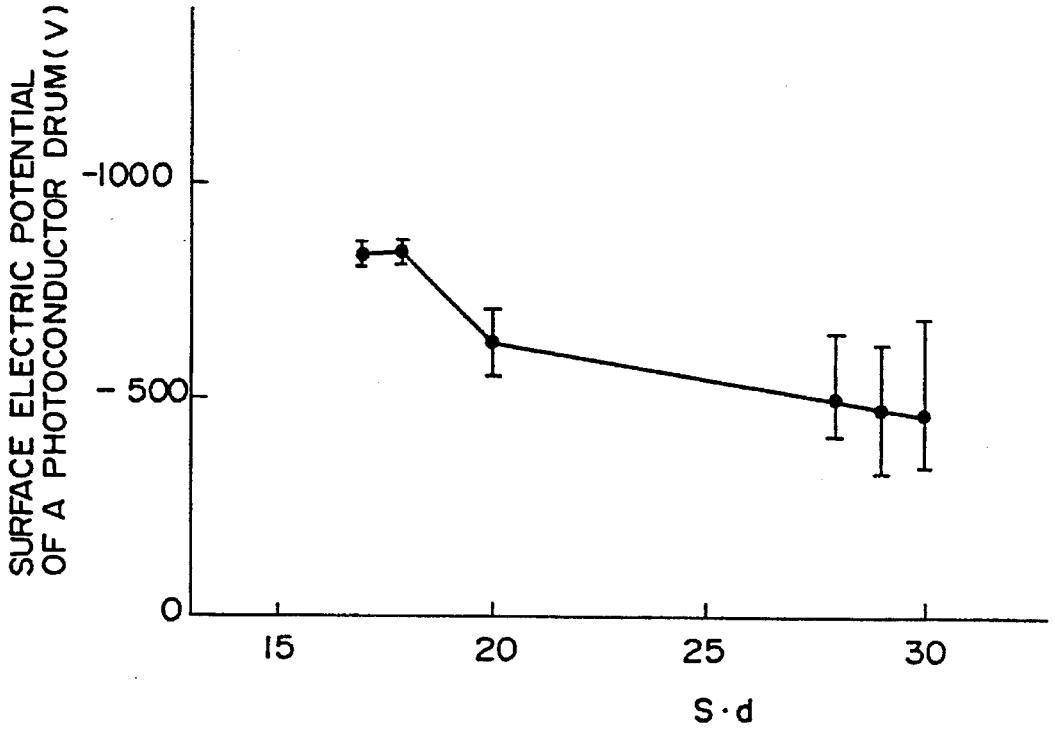
FIG. 14 is a view showing the relation between the characteristic value of toner particles and the surface potential of a photoconductor drum.

FIG. 14 is a view showing the relation between the characteristic value S.d and the surface potential of the photoconductor drum 1. The surface potential of the photoconductor drum 1 in FIG. 14 is measured before the exposure process starts upon completion of the charging process when the continuous printing is performed under the condition that the voltage of the power source 2*b* (FIG. 1) is −1.4 [kV]. When the characteristic value S.d is less than 18, the amount of toner particles stuck to the charging roller 2 is substantially zero and the surface potential of the photoconductor drum 1 is −840 [V]±10 [V]. If the characteristic value S.d exceeds 20, the surface potential of the photoconductor drum 1 is decreased and much varied. This is caused by the fact that the voltage of the power source 2*b* is distributed to the dielectric layer of the photoconductor drum 1 and the toner layer on the charging roller 2. It seems that the degree of the variation is caused by the variation of the thickness of the toner layer and the density of filling of the toner particles in the longitudinal direction. In view of the grounds set forth above, if the characteristic value S.d exceeds 28, a solid image appears thick at a part of the non-image portion of the photoconductor drum 1. That is, the amount of the toner particles to be stuck to the charging roller 2 should be substantially zero in order to stabilize the surface potential of the photoconductor drum 1 in the continuous operation. For this reason, it is necessary for the toner particles to be spherical or to have the shapes close to the spherical shapes.

The following comparative test has been made in order to more clarify the phenomenon that the spherical toner particles are not liable to be stuck to the charging roller 2.

Figure 15:
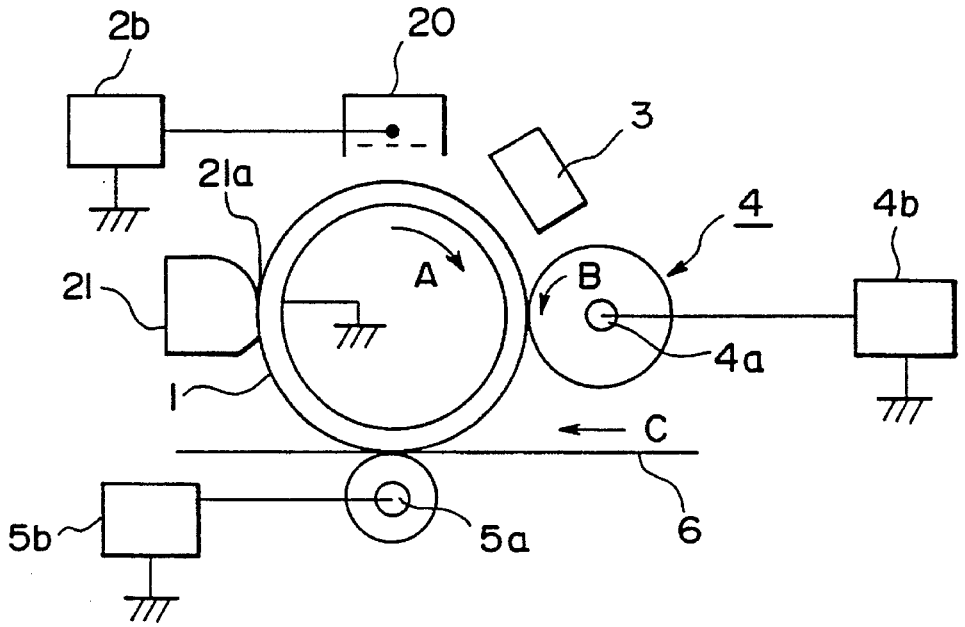
FIG. 15 is a schematic view of an electrophotographic apparatus to which a conventional method for forming an image is applied.
Figure 16:
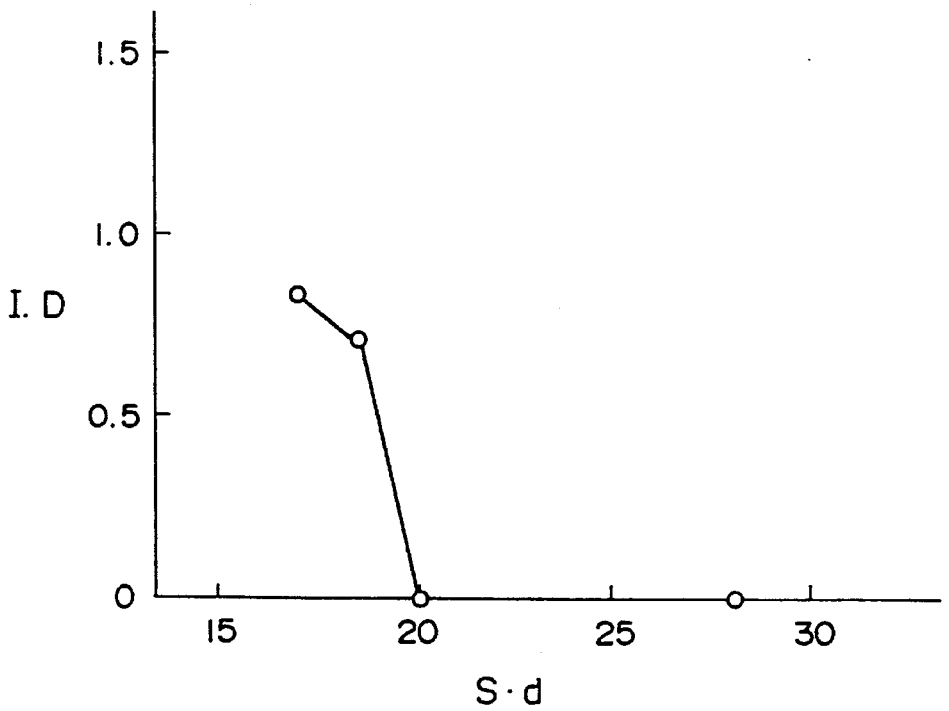
FIG. 16 is a view showing the relation between the characteristic value and the density of toner particles.

FIG. 15 is a schematic view of an electrophotographic apparatus to which a conventional method for forming an image is applied and FIG. 16 is a view showing the relation between the characteristic value and density of toner particles caused by the inferior cleaning.

A blade-type cleaning device 21 is provided at the side opposite to the photoconductor drum 1. The voltage of the power source 2*b* is regulated so that the surface potential of the photoconductor drum 1 becomes −840 [V]. The cleaning device has a cleaning blade 21*a* which is formed of a urethane rubber having a thickness of 1.8 [mm], and has a hardness of JISA 70° and a blade length of 11 [mm]. The cleaning blade 21*a* is disposed along a full width of the photoconductor drum 1 under the condition that an angle for positioning thereof relative to the photoconductor drum 1 is 24° and deflection thereof is 2 [mm].

Denoted at I. D. in the vertical axis of the graph in FIG. 16 is a reflection density representing the amount of toner particles which remain on the photoconductor drum 1 and are poorly cleaned before the developing process starts after passing the cleaning blade 21*a* provided that the continuous printing is performed in the same way as explained in FIGS. 13 and 14 under the condition set forth above. The toner particles employed here are those as denoted at I to L as illustrated in FIG. 12. The graph shows that the toner particles which remain on the photoconductor drum 1 are liable to pass the cleaning blade 21*a* if the characteristic value S.d is less than 18.2 and are poorly cleaned, which increases the reflection density, i.e. I.D. If the characteristic value S.d exceeds 20, the toner particles are better cleaned, which renders the I.D. to be substantially zero.

The result of test reveals the following:

The spherical toner particles are not liable to be cleaned compared with the non-spherical toner particles. The reason of the increase of the poor cleaning is that the spherical toner particles are strong in the Van der Waals force to the photoconductor drum and the toner particles slip under the cleaning blade 21 because of the spherical shape.

The Van der Waals force to the surfaces of particles generally depends on the random surface roughness of the particles. Accordingly, if the particle size is same, it is well known that the smoother the surface of the particle is, the stronger the sticking force is.

The poor cleaning is specified using a threshold value, on the substantially same characteristic value S.d as illustrated in FIG. 13. It is evident that the toner particles remaining on the photoconductor drum are liable to remain on the photoconductor drum when they are stuck to the charging roller or the cleaning blade.

The toner particles stuck to the charging roller 2 is not largely varied even if the electrostatic force which influences the toner particles remaining within the charged area, is varied. The Van der Waals force and the shapes of the toner particles affect largely the behavior of the toner.

The present invention should not be limited to the first to sixth embodiments set forth above but many variations and changes are possible based on the gist of the present invention without departing from the scope thereof.

As set forth above in detail, since the image carrier is charged with electricity by the charging roller while the latter contacts the surface of the former, there is no likelihood of generation of the harmful substance such as ozone which has been caused by the corona discharge and no likelihood of environmental pollution. Although the toner particles remain on the image carrier upon completion of the transferring process, these toner particles can be collected by the developing roller owing to the electrostatic force. Accordingly, it is not necessary to dispose of the collected toner particles, which improves the efficiency of using the toner particles.

If the turning direction of the developing roller is opposite to that of the image carrier and the peripheral velocity of the developing roller exceeds 1.2 times that of the image carrier, the efficiency of collecting the toner particles is enhanced and the efficiency of using the toner particles is improved.

In case that the absolute value of the potential of the charging roller is lessened while no printing operation is performed, the toner particles which are stuck to the charging roller are stuck by the image carrier owing to the electrostatic force, whereby the amount of the toner particles which are stuck to the charging roller can be reduced. Accordingly, it is possible to charge the surface of the image carrier with electricity uniformly, whereby the stable image can be obtained.

The charging unit may comprise the charging roller and the turning direction of the charging roller may be opposed to that of the image carrier. Furthermore, the peripheral velocity of the charging roller can be differentiated from that of the image carrier. That is, the peripheral velocity of the charging roller can be less than or greater than that of the image carrier.

In this case, the toner particles remaining on the image carrier are moved while the image carrier is charged with electricity by the charging roller. Accordingly, it is possible to sufficiently collect the toner particles in the developing process since not only the portion to which the toner particles have been stuck before the movement of the toner particles but also the portion to which the toner particles are stuck after the movement are uniformly charged with electricity.

If the peripheral velocity of the charging roller is less than that of the image carrier, there occurs an effect that the toner particles are stuck to the image carrier which has a high peripheral velocity so that the amount of the toner particles which are stuck to the charging roller can be reduced. As a result, the surface of the image carrier can be uniformly charged with electricity, whereby the stable image can be obtained.

It is possible to provide the toner holding roller which contacts the image carrier and is disposed between the transfer unit and the charging unit. In this case, the toner particles remaining on the image carrier are once stuck by the toner holding roller and thereafter the toner particles are returned to the image carrier little by little as the toner holding roller rotates. Accordingly, the toner layer formed on the surface of the image carrier is thinned, which can prevent the insufficient exposure of the image carrier.

Since the toner particles which are stuck to the charging roller and carry the polarity inverse to that of the charging roller may carry the polarity same as that of the charging roller by way of the conductive blade and move toward the image carrier, the amount of toner particles stuck to the charging roller can be reduced. As a result, it is possible to charge the surface of the image carrier with electricity uniformly, whereby the stable image can be obtained.

Since the toner particles remaining on the non-image portion of the image carrier are attracted by the auxiliary developing roller owing to the electrostatic force and move to the image-portion of the image carrier, they do not remain thick on the auxiliary developing roller. Accordingly, the amount of the toner particles stuck to the image portion can be reduced by the auxiliary developing roller by the amount stuck by the developing roller so that the efficiency of using the toner particles can be improved.

Since the charging member connected to the power source charges the surface of the image carrier with electricity in the charging process while the former contacts the surface of the latter, there is no likelihood of generation of the harmful substance such as ozone caused by the corona discharge.

The toner particles remaining on the image carrier at the time of completion of the transferring process can be collected owing to the electrostatic force before the transferring process starts after the completion of the charging process, e.g. in the developing process.

Since the shapes of the toner particles are spherical and the characteristic value S.d which is given by the product of the BET ratio surface area S [$m^2/g$] and the volume average particle size d [μm] is less than 18, the amount of toner particles stuck to the charging member can be reduced and the voltage which is applied by the power source connected to the charging member is not distributed to the toner particles on the charging member, whereby the surface potential on the image carrier can be stabilized and also the high resolution and high quality image can be obtained.

Since the toner particles remaining on the image carrier can be collected owing to the electrostatic force before the transferring process starts after the completion of the charging process, for instance, in the developing process, they can be sufficiently collected regardless of the shapes thereof. Accordingly, it is possible to recycle the collected toner particles.

What is claimed is:

1. An image forming apparatus comprising:

an image carrier rotatable by a driving mechanism in a first direction at a predetermined peripheral velocity;

a charging roller connected to a source of charge and comprising an elastomeric roller with an even surface and contacted to a surface of the image carrier, the charging roller being rotatable by a driving mechanism in a direction opposite to the direction of rotation of the image carrier at a peripheral velocity different from the peripheral velocity of the image carrier, and moving toner particles remaining on the image carrier for uniformly charging the surface of the image carrier with electricity, the peripheral velocity of the charging roller being about 1.1–2 times faster than the peripheral velocity of the image carrier, the charging roller moving the toner particles without causing toner particle dust to pollute the image forming apparatus;

a conductive element pressed into contact with a surface of the charging roller, the conductive element for charging toner particles on the charging roller such that the charged toner particles move from the charging roller to the image carrier;

a latent image forming unit for forming an electrostatic latent image on the surface of the image carrier which has been charged with electricity;

a developing roller disposed adjacent to the image carrier for developing the electrostatic latent image formed on the surface of the image carrier to thereby form a toner image;

a transfer means for transferring the toner image formed on the surface of the image carrier to a transfer member;

a fixing means for fixing the toner image to the transfer member; and a power source connected to the developing roller for charging toner particles on the developing roller with electricity having a same polarity as a charging polarity of the image carrier, and for setting a potential of the developing roller to a value capable of allowing the toner particles to be stuck to an image portion of the image carrier and of allowing the toner particles remaining on a non-image portion of the image carrier to be attracted by the developing roller, the conductive element being electrically connected to a negative power source for contacting and negatively charging positively charged toner particles on the charging roller to form negatively charged toner particles, the negatively charged toner particles being movable from the charging roller to the image carrier.

2. An image forming apparatus according to claim 1, wherein the peripheral velocity of the elastomeric roller of the charging roller is 1.1–2.0 times faster than the peripheral velocity of the image carrier.

3. An image forming apparatus according to claim 1 wherein the elastomeric roller comprises a semiconductive material.

4. An image forming apparatus comprising:

an image carrier;

a charging roller for charging a surface of the image carrier uniformly with electricity;

a conductive element pressed into contact with a surface of the charging roller, the conductive element for charging toner particles on the charging roller such that the charged toner particles move from the charging roller to the image carrier;

a latent image forming unit for forming an electrostatic latent image on the surface of the image carrier which is charged with electricity;

a developing roller disposed adjacent to the image carrier for developing the electrostatic latent image formed on the surface of the image carrier to thereby form a toner image;

a transfer means for transferring the toner image formed on the surface of the image carrier to a transfer member;

a fixing means for fixing the toner image to the transfer member; and a power source connected to the developing roller for charging toner particles on the developing roller with electricity with a same polarity as a charging polarity of the image carrier, and for setting a potential of the developing roller to a value capable of allowing the toner particles to be stuck to an image portion of the image carrier and of allowing the toner particles remaining on a non-image portion of the image carrier to be attracted by the developing roller, the conductive element being electrically connected to a negative power source for contacting and negatively charging positively charged toner particles on the charging roller to form negatively charged toner particles, the negatively charged toner particles being movable from the charging roller to the image carrier.

5. An image forming apparatus comprising:

an image carrier rotatable in a first direction at a predetermined peripheral velocity;

a charging unit contacted to the surface of the image carrier, the charging unit comprising a semiconductive elastic roller rotatable in a direction opposite to the direction of rotation of the image carrier at a peripheral velocity different from the peripheral velocity of the image carrier, and moving toner particles remaining on the image carrier, said charging unit for uniformly charging a surface of the image carrier with electricity, the peripheral velocity of the elastic roller being about 1.1–2 times faster than the peripheral velocity of the image carrier, the charging unit moving the toner particles without causing toner particle dust to pollute the image forming apparatus;

a conductive element pressed into contact with a surface of the charging unit, the conductive element for charging toner particles on the charging unit such that the charged toner particles move from the charging unit to the image carrier;

a latent image forming unit for forming an electrostatic latent image on the surface of the image carrier which has been charged with electricity;

a developing roller disposed adjacent to the image carrier for developing the electrostatic latent image formed on the surface of the image carrier to thereby form a toner image;

a transfer means for transferring the toner image formed on the surface of the image carrier to a transfer member;

a fixing means for fixing the toner image to the transfer member; and a power source connected to the developing roller for charging toner particles on the developing roller with electricity having a same polarity as a charging polarity of the image carrier, and for setting a potential of the developing roller to a value capable of allowing the toner particles to be stuck to an image portion of the image carrier and of allowing the toner particles remaining on a non-image portion of the image carrier to be attracted by the developing roller, the conductive element being electrically connected to a negative power source for contacting and negatively charging positively charged toner particles on the charging unit to form negatively charged toner particles, the negatively charged toner particles being movable from the charging unit to the image carrier.

* * * * *